US007647856B2

(12) United States Patent
Park et al.

(10) Patent No.: US 7,647,856 B2
(45) Date of Patent: Jan. 19, 2010

(54) MISSILE LAUNCH AND GUIDANCE APPARATUS

(75) Inventors: Tae-Hak Park, Daejeon (KR); Sang-Hun Shin, Daejeon (KR)

(73) Assignee: Agency for Defense Development (KR)

( * ) Notice: Subject to any disclaimer, the term of this patent is extended or adjusted under 35 U.S.C. 154(b) by 311 days.

(21) Appl. No.: 11/618,217

(22) Filed: Dec. 29, 2006

(65) Prior Publication Data

US 2007/0283800 A1 Dec. 13, 2007

(30) Foreign Application Priority Data

Jun. 9, 2006 (KR) ..... 10-2006-0052209

(51) Int. Cl.
*F41F 3/052* (2006.01)

(52) U.S. Cl. ..... 89/1.806; 89/1.819

(58) Field of Classification Search ..... 89/36.01, 89/36.02, 36.03, 36.04, 36.07, 36.08, 36.09, 89/36.12, 36.17, 1.806, 1.808, 1.819, 188, 89/304.4, 313.3, 314.2, 321.5, 457, 911
See application file for complete search history.

(56) References Cited

U.S. PATENT DOCUMENTS

| | | | | |
|---|---|---|---|---|
| 3,115,059 | A * | 12/1963 | Moul, Jr. | 89/1.819 |
| 3,967,529 | A * | 7/1976 | Ingle et al. | 89/1.819 |
| 4,392,411 | A * | 7/1983 | Minkler | 89/1.819 |
| 5,125,319 | A * | 6/1992 | Goricke et al. | 89/1.806 |
| 5,291,820 | A * | 3/1994 | Hainsworth et al. | 89/1.806 |
| 5,398,588 | A * | 3/1995 | Peck | 89/1.806 |
| 5,463,927 | A * | 11/1995 | Lewis | 89/1.801 |
| 6,769,345 | B2 * | 8/2004 | Grange et al. | 89/1.816 |
| 2007/0175323 | A1 * | 8/2007 | Kim et al. | 89/1.819 |

FOREIGN PATENT DOCUMENTS

| | | |
|---|---|---|
| JP | 6-011297 | 1/1994 |
| KR | 20-0220222 | 2/2001 |

OTHER PUBLICATIONS

Untranslated Office Action issued by Korean Patent Office on Feb. 22, 2007 in connection with corresponding Korean Application No. 10-2006-0052209.

* cited by examiner

*Primary Examiner*—Bret Hayes
(74) *Attorney, Agent, or Firm*—Ostrolenk Faber LLP

(57) ABSTRACT

A missile launch and guidance apparatus of a rail-shoe launching type is disclosed. In a missile adapted to be launched while moving along a rail of a launch tube, a missile launch and guidance apparatus comprises: a bushing inserted into a missile body; a shoe, one end of which is inserted into the bushing, and the other end of which is in contact with the rail; and a spring inserted between the bushing and the shoe so as to provide a separation force to the shoe against the bushing. By separating the shoe from the missile in a lateral direction of the missile launching direction by an elastic force of the spring after launching the missile, the missile launch and guidance apparatus can keep constant the gap between the missile and the launch tube rail irrespective of the behavior of the missile taking place in a launching process, and the drag and weight of the missile launched from the launch tube is reduced to thereby exhibit the maximum flight performance.

2 Claims, 6 Drawing Sheets

MISSILE LAUNCH AND GUIDANCE APPARATUS

RELATED APPLICATION

The present disclosure relates to subject matter contained in priority Korean Application No. 10-2006-0052209, filed on Jun. 9, 2006, which is herein expressly incorporated by reference in its entirety.

BACKGROUND OF THE INVENTION

1. Field of the Invention

The present invention relates to a missile launch and guidance apparatus of a rail-shoe launching type, and more particularly, to a missile launch and guidance apparatus, which keeps constant the gap between a shoe and a launch tube rail regardless of the behavior of a missile taking place in a launching process, and reduces the drag and weight of an in-flight missile as the shoe is separated from the missile after launching, thereby exhibiting the maximum flight performance.

2. Description of the Related Art

In general, a missile launch and guidance apparatus of a rail-shoe launching type is designed to firmly restrain a missile in the normal position of a launch tube rail so as to avoid structural changes induced by the force applied from the outside and the self-weight of the missile in the operation of a missile system.

A shoe is designed in a profile that is advantageous from the aerodynamic standpoint so as to minimize degradation in flight performance such as drag inducement while maintaining sufficient structural strength with respect to a launch load generated in a launching process. For this, a conventional missile shoe is assembled in a manner to be fixed integrally to a missile body so as not to be separated from it.

At least one of the conventional shoe fixed integrally to the missile body is installed according to the center of gravity of the missile. The shoe firmly and steadily support the missile on the rail of the launch tube at the time of a pre-launching operation, while it carries out sliding movement on the rail of the launch tube at the time of launching.

However, the conventional shoe, which is designed so as to have sufficient structural strength with respect to self-weight, external loads, external impacts, and launch loads, is assembled so as not to be separated from the missile body, which leads to a problem of increase in drag force during the flight of the missile.

Moreover, in order to smoothly move the missile along the rail surface of the launch tube, there exists a gap between the launch tube rail and the shoe due to a tolerance provided by considering launching dynamics, manufacture, and assembling. If a manufactured state of the launch tube rail is poor, the gap between the launch tube rail and the shoe becomes extremely smaller or larger, which causes the missile to be caught in the launch tube rail or makes the start-up of the missile unstable, thereby affecting the structural safety of the missile and of the launch tube and rail components at the time of missile operation and launching.

BRIEF DESCRIPTION OF THE INVENTION

The present invention has been devised in consideration of these problems, and an object of the present invention is to provide a separable shoe apparatus for a missile, which can reduce the drag and flight weight of the missile and prevent an unstable behavior by separating the shoe from the missile after launching the missile.

To accomplish the object of the present invention, there is provided a shoe apparatus, comprising: a bushing insertion hole formed at a missile frame; a bushing inserted into the bushing insertion hole; a fastening screw coupling the bushing and the frame of the missile; a shoe having a cylindrical boss portion formed at one end and a rail assembly portion formed at the other end, for fixing and guiding the missile, the cylindrical boss portion being inserted into the bushing and the rail assembly portion being placed on a launch stand rail; and an elastic member inserted between the bushing and the shoe.

Additionally, there is provided a shoe apparatus according to the present invention, comprising: a bushing insertion hole formed at a missile frame; a bushing inserted into the bushing insertion hole; a fastening screw coupling the bushing and the frame of the missile; a shoe having a cylindrical boss portion formed at one end and a rail assembly portion formed at the other end, for fixing and guiding the missile, the cylindrical boss portion being inserted into the bushing and the rail assembly portion being placed on a launch stand rail; and a pressure cartridge for separating the shoe from the missile.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The construction and operation according to one embodiment of the present invention will now be described in detail with reference to the accompanying drawings.

Figure 1:
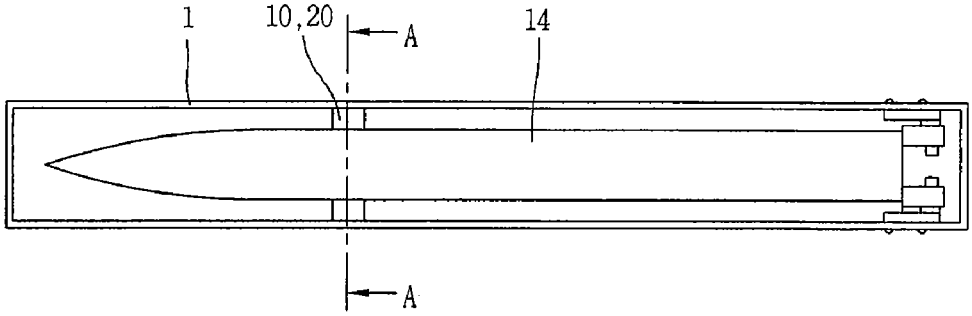
FIG. 1 is a vertical sectional view showing a construction in which a missile equipped with a missile launch and guidance apparatus according to the present invention is mounted within a launch tube.
Figure 2:
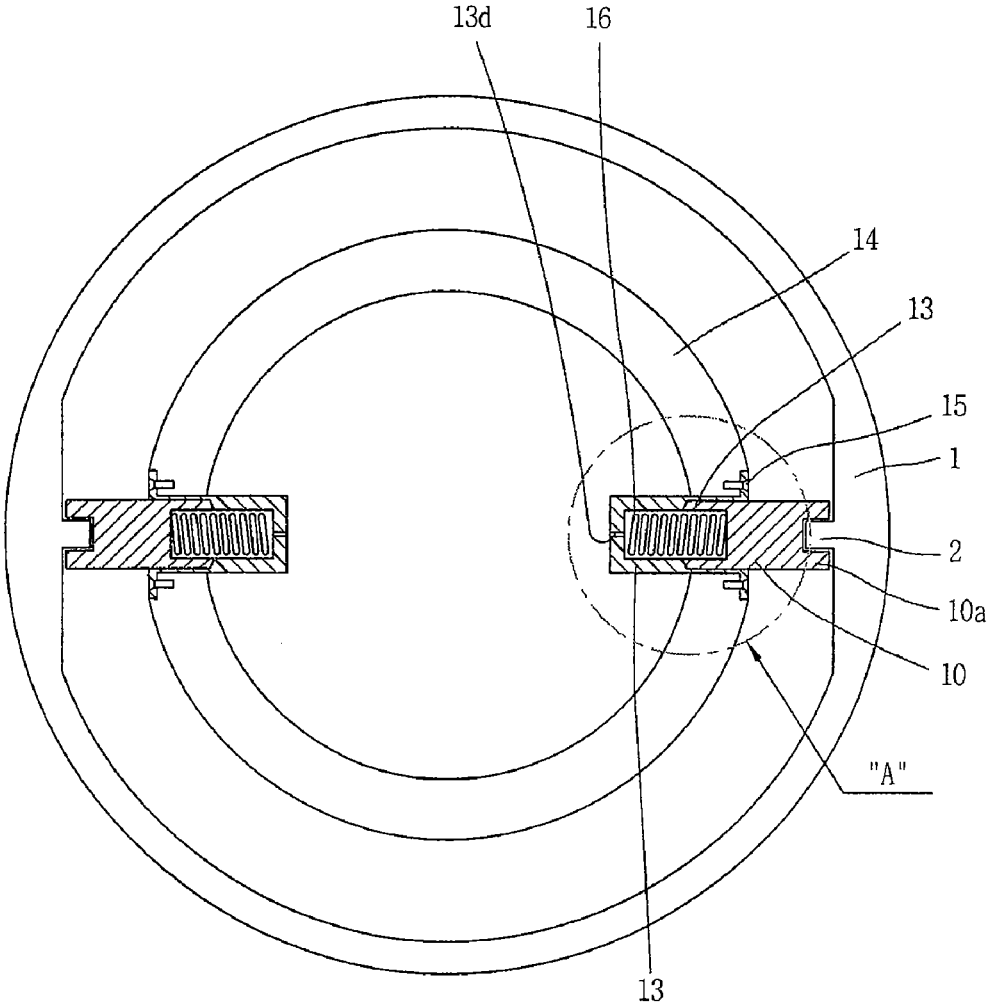
FIG. 2 is a sectional view showing the construction of a missile launch and guidance apparatus according to one embodiment of the present invention taken along cut line II-II of FIG. 1.
Figure 3:
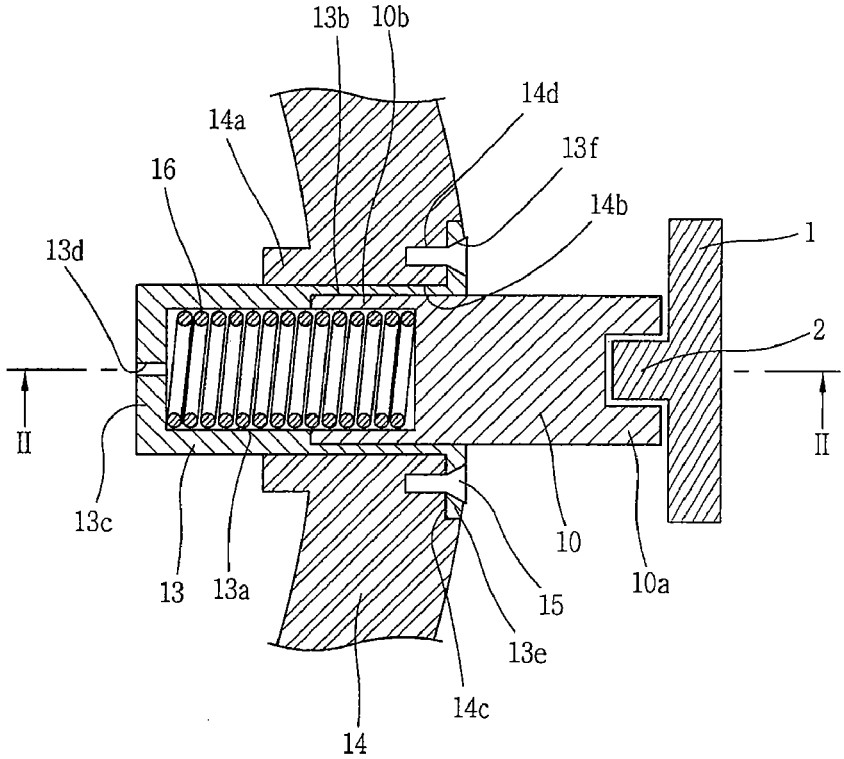
FIG. 3 is an enlarged view of "A" portion of FIG. 2.
Figure 4:
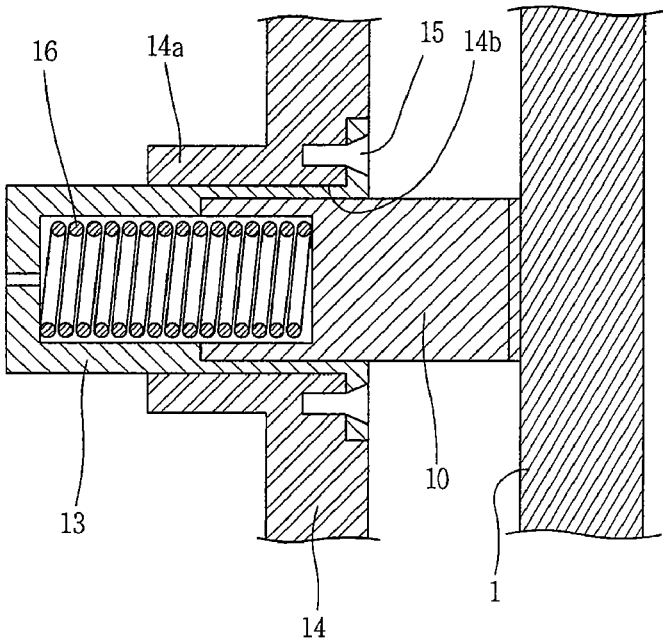
FIG. 4 is a vertical sectional view taken along cut line IV-IV of FIG. 3.

FIG. 1 is a vertical sectional view showing a construction in which a missile equipped with a missile launch and guidance apparatus according to the present invention is mounted within a launch tube. FIG. 2 is a sectional view showing the construction of a missile launch and guidance apparatus according to one embodiment of the present invention taken along cut line II-II of FIG. 1. FIG. 3 is an enlarged view of "A" portion of FIG. 2. FIG. 4 is a vertical sectional view taken along cut line IV-IV of FIG. 3.

As shown in FIGS. 1 through 4, a shoe 10 according to one embodiment of the present invention has a boss portion 10*b* formed at one end and a rail assembly portion 10*a* in contact with a launch tube rail 2 formed at the other end, and thus serves to fix and guide a missile between a bushing 13 assembled to a missile body 14 by a fastening screw 15 and the rail 2 of the launch tube 1, so that the missile is firmly restrained and operated in the normal position of the rail 2 of the launch tube 1.

A bushing receiving groove 14*b* for receiving the bushing 13 is formed in the missile body, and a flange mounting portion 14*c* for coupling to a flange portion 13*e* of the bushing is formed at one end of the bushing receiving groove 14*b*. A screw groove 14*d* for fastening the fastening screw 15 is formed at the flange mounting portion 14*c*.

The missile body 14 and the bushing 13 may be coupled by the fastening screw 15, or coupled by press-fitting the bushing or by welding or riveting. If it is desired to separately manufacture a bushing and insert and couple it to the missile body as stated above, bushings of various dimensions and shapes can be separately manufactured, which is advantageous to the mass production of bushings.

Alternatively, the missile body 14 and the bushing 13 may be formed integral with each other. In this case, it is effective to use integral machining by a machine. This can eliminate the process of inserting the bushing 13 into the missile body 14, and thus the manufacturing process of a shoe apparatus is simplified, thereby improving productivity.

The bushing receiving groove 14*b* may be formed in a hole penetrating through the missile body 14.

At the other end of the bushing receiving groove 14*b*, a flange portion 14*a* having a predetermined thickness is protruded inward from the missile body 14 in order to prevent degradation in structural strength of the bushing receiving groove 14*b*.

The bushing 13 is formed in the shape of a tube with one end blocked, and comprises an opening 13*b* for receiving the boss portion 10*b* of the shoe 10, a flange portion 13*e* extending from one end of the opening 13*b* to the outer peripheral surface thereof, a spring mounting portion 13*a* stepped with the other end of the opening 13*b* and formed integral therewith, and a spring support portion 13*c*.

The spring 16 is installed in the space of the spring mounting portion 13*a*, and one end of the spring 16 is supported by the spring support portion 13*c*.

An air vent hole 13*d* is formed at the spring support portion 13*c* of the bushing 13, for preventing separation performance of the shoe 10 from being degraded by sealing induced by precision finishing of the bushing 13. Air can be uniformly eliminated by forming the air vent hole 13*d* at the center part of the spring support portion 13*c*.

A screw through hole 13*f* for the fastening screw 15 fixing the missile body 14 and the bushing 13 is perforated in the flange portion 13*e*.

The shoe 10 comprises a boss portion 10*b* at one end and a rail assembly portion 10*a* at the other end, and the boss portion 10*b* is mounted on the opening 13*b* of the bushing 13.

By enabling the rotation of the shoe by forming the profile of the boss portion 10*b* in a cylindrical form, the missile can maintain a constant sliding function irrespective of an unstable behavior of the missile during a launching process and the surface state of the launch tube rail 2. The rail assembly portion 10*a* functions to fix and guide the missile by a contact with the rail 2 of the launch tube 1.

The spring 16 is mounted between the spring support portion 13*c* of the bushing 13 and the boss portion 10*b* of the shoe 10.

Figure 5:
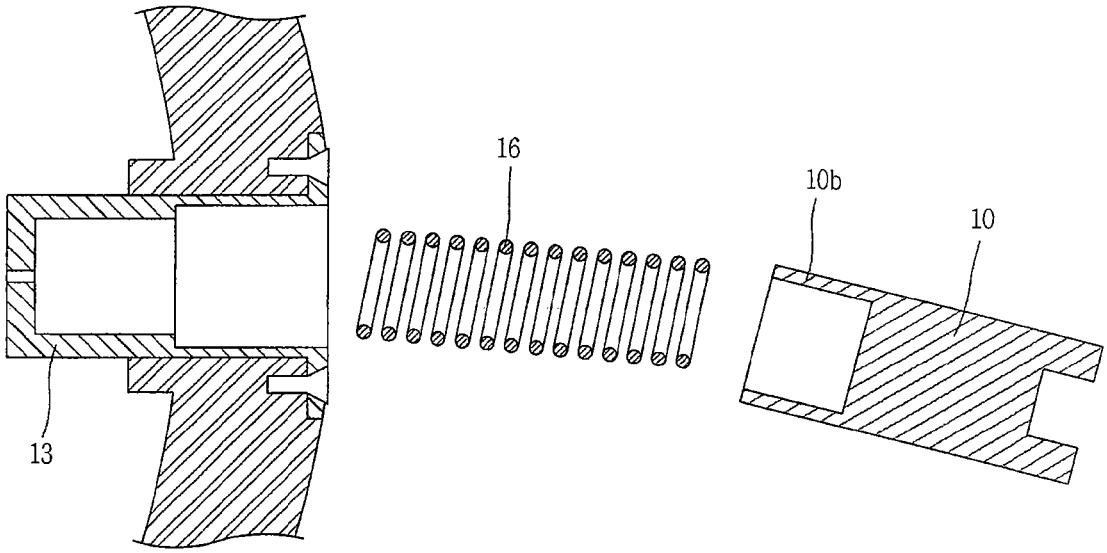
FIG. 5 is a view for explaining the operation of the missile launch and guidance apparatus of FIG. 3.

By the above construction, the operation according to one embodiment of the present invention will be described with reference to FIG. 5.

When a missile is launched by combustion of a missile propellant (not shown), a rail assembly portion 10*a* of a shoe 10 carries out sliding movement on a rail 2 of a launch tube 1 in the launching direction. The instant when the rail assembly portion 10*a* of the shoe 10 deviates from the rail 2 of the launch tube 1, the shoe 10 enters into a free state with no restriction. At this point, as the spring 16 mounted in a compressed state between the bushing 13 and the shoe 10 is restored to the original state, the shoe 10 inserted into the bushing 13 is pushed outward from the missile radius direction, thereby separating the shoe 10 from the missile body 14.

As previous described in one embodiment of the present invention, although the application of a spring to a missile launch and guidance apparatus in order to generate a shoe separating force offers simplicity in construction and principle and high reliability, geometrical restrictions are imposed on the increase of an elastic force serving as the separation force. Thus, it is preferred to apply a spring to missiles where the separation speed of the shoe is not important.

A missile launch and guidance apparatus according to another embodiment of the present invention will now be described with reference to FIGS. 6 through 9.

Figure 6:
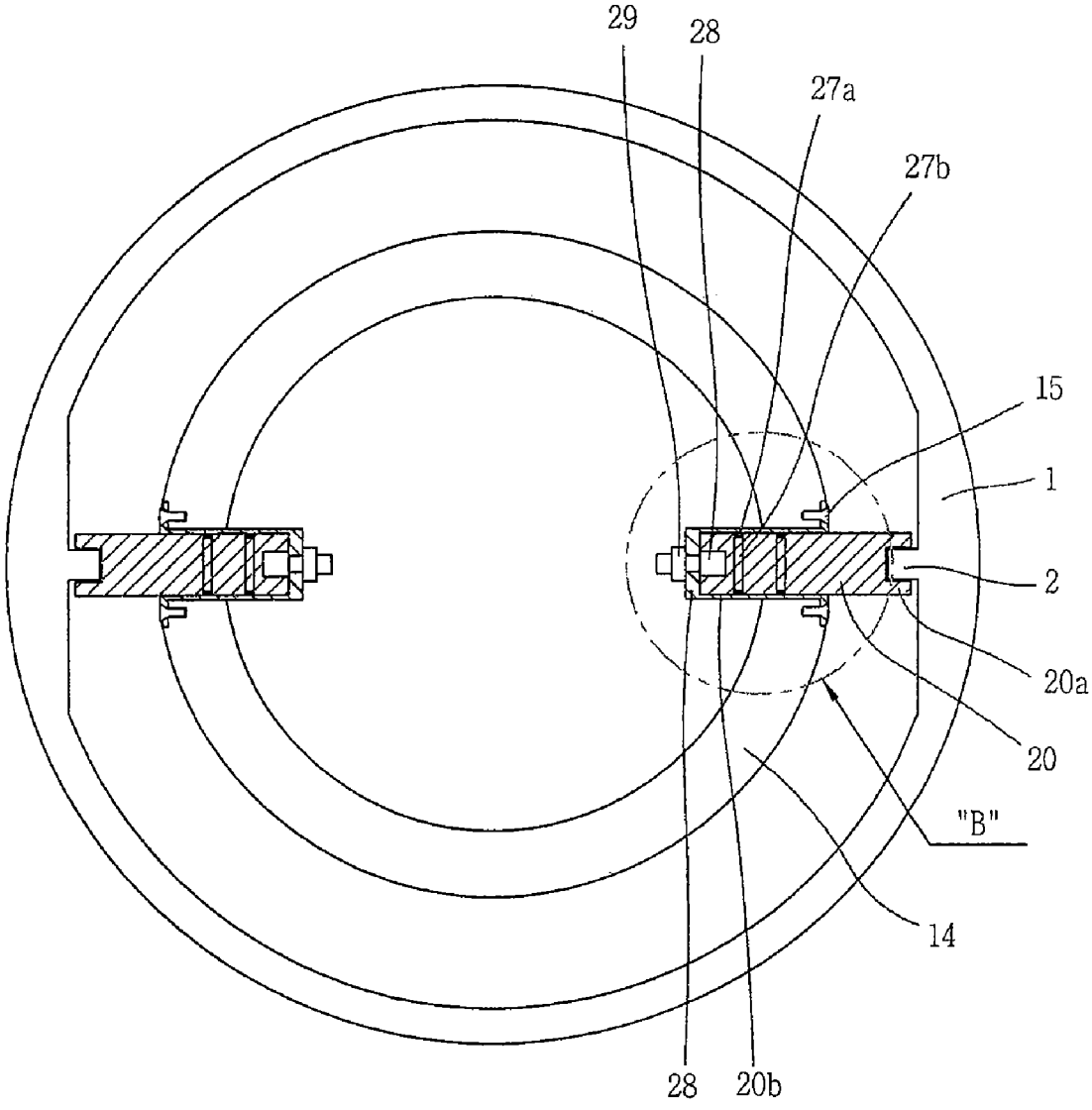
FIG. 6 is a sectional view showing the construction of a missile launch and guidance apparatus according to another embodiment of the present invention taken along cut line II-II of FIG. 1.
Figure 7:
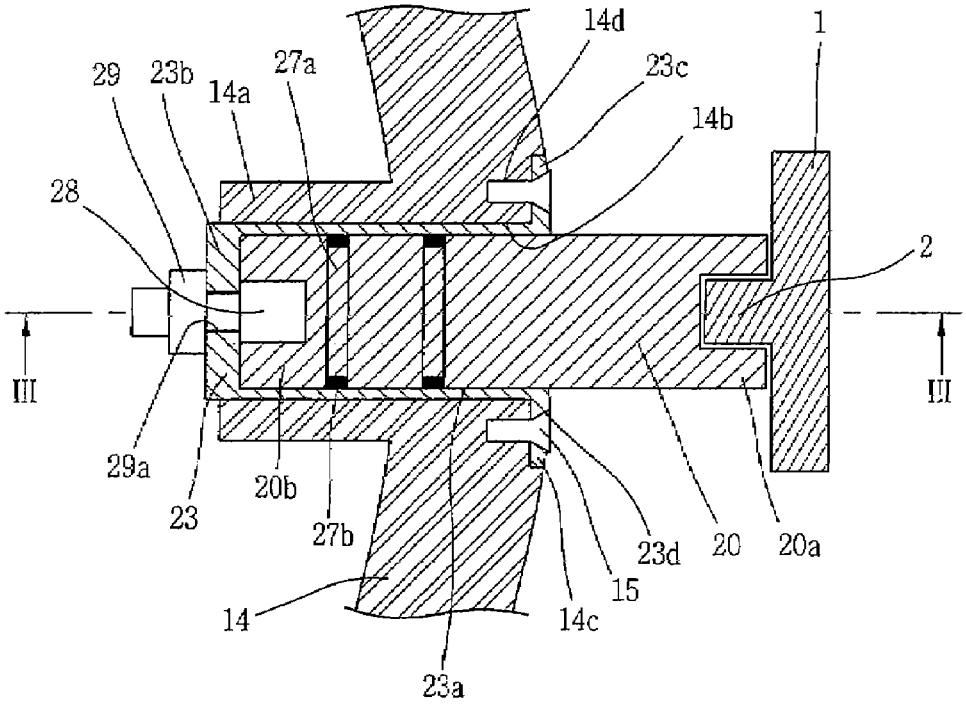
FIG. 7 is an enlarged view of "B" portion of FIG. 6.
Figure 8:
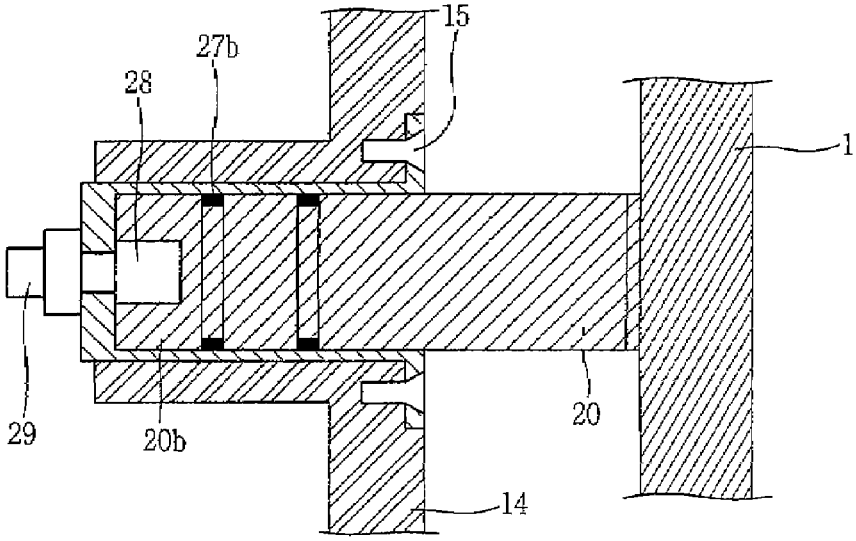
FIG. 8 is a vertical sectional view taken along cut line VIII-VIII of FIG. 7.
Figure 9:
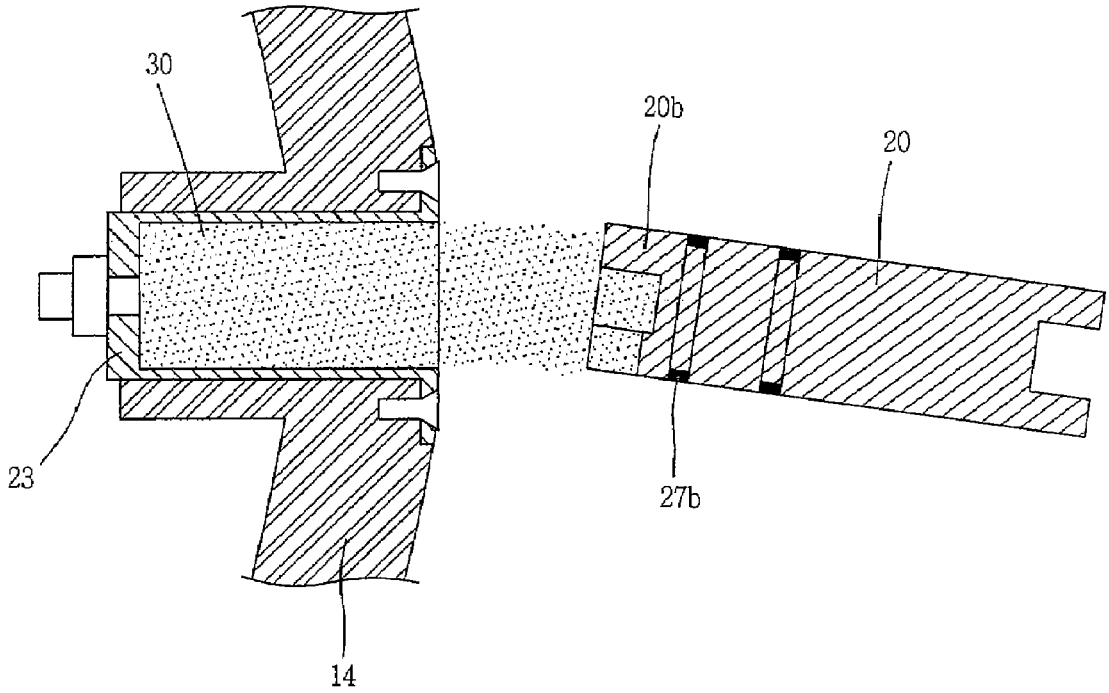
FIG. 9 is a view for explaining the operation of the missile launch and guidance apparatus of FIG. 7.

FIG. 6 is a sectional view showing the construction of a missile launch and guidance apparatus according to another embodiment of the present invention taken along cut line II-II of FIG. 1. FIG. 7 is an enlarged view of "B" portion of FIG. 6. FIG. 8 is a vertical sectional view taken along cut line VIII-VIII of FIG. 7. FIG. 9 is a view for explaining the operation of the missile launch and guidance apparatus of FIG. 7.

As shown in FIGS. 6 through 8, a shoe 20 according to another embodiment of the present invention is assembled between a rail 2 of a launch tube 1 and a bushing 23 assembled to a missile body 14 by a fastening screw 15 to serve to fix and guide a missile, so that the missile is firmly restrained and operated in the normal position of the rail 2 of the launch tube 1.

A bushing receiving groove 14*b* for receiving the bushing 23 is formed in the missile body 14, and a flange mounting portion 14*c* for coupling to a flange portion 23*c* of the bushing 23 is formed at one end of the bushing receiving groove 14*b*. A screw groove 14*d* for fastening the fastening screw 15 is formed at the flange mounting portion 14*c*.

The missile body 14 and the bushing 23 may be coupled by the fastening screw 15, or coupled by press-fitting the bushing or by welding or riveting.

If it is desired to separately manufacture a bushing 23 and insert and couple it to the missile body as stated above, bushings 23 of various dimensions and shapes can be separately manufactured, which is advantageous to the mass production of bushings.

Alternatively, the missile body 14 and the bushing 23 may be formed integral with each other. In this case, it is effective to use integral machining by a machine. This can eliminate the process of inserting the bushing 23 into the missile body 14, and thus the manufacturing process of a shoe apparatus is simplified.

The bushing receiving groove 14*b* may be formed in a hole penetrating through the missile body 14.

At the other end of the bushing receiving groove 14*b*, a flange portion 14*a* having a predetermined thickness is protruded inward from the missile body 14 in order to prevent degradation in structural strength of the bushing receiving groove 14*b*.

The bushing 23 is formed in the shape of a tube with one end blocked, and comprises an opening 23*a* for receiving a boss portion 20*b* of the shoe 20, a flange portion 23*c* extending from one end of the opening 23*b* to the outer peripheral surface thereof, and a support portion 23*b* formed at the opposite side of the opening 23*a*.

A pressure cartridge mounting portion 29*a* for assembling a pressure cartridge 29 is formed in the support portion 23*b*. A mounting hole penetrating the support portion 23*b* of the bushing is formed in the pressure cartridge mounting portion 29*a* in order to easily mount the pressure cartridge on the bushing 23.

A screw through hole 23*d* for the fastening screw 15 fixing the missile body 14 and the bushing 23 is perforated in the flange portion 23*c*.

The shoe 20 has a boss portion 20*b* formed at one end and a rail assembly portion 20*a* formed at the other end, and the boss portion 20*b* is inserted into the opening 23*a* of the bushing 23.

By enabling the rotation of the shoe by forming the profile of the boss portion 20*b* in a cylindrical form, the missile can maintain a constant sliding function irrespective of an unstable posture of the missile during a launching process and the surface state of the rail 2 of the launch tube 1. The rail assembly portion 20*a* functions to fix and guide the missile by a contact with the rail 2 of the launch tube 1. A pressure concentrating portion 28 for concentrating a burst pressure of the pressure cartridge 29 is formed at the center of the boss portion 23 of the shoe 20. The pressure concentrating portion 28 is formed in the boss portion 20*b*, which is a front part of the shoe 20, so that an explosive gas pressure of gunpowder can be concentrated in the space between the bushing 23 and the shoe 20.

An O-ring groove 27*a* is formed on the outer peripheral surface of the boss portion 20*b* of the shoe 20 to mount an O-ring 27*b* for maintaining a pressure of a predetermined level without leakage of the explosive gas pressure of gunpowder.

The pressure cartridge 29 is mounted on the outer surface opposite to the opening 23*a* of the bushing 23 through the pressure cartridge mounting portion 29*a* of the bushing 23. That is, it is mounted on the outer surface of the support portion 23*b* of the bushing 23 so as to be consistent with the horizontal axial direction of the missile body 14. At this time, the pressure cartridge 29 is mounted on the outer surface of the bushing 23 by using a tap (not shown).

By the above construction, the operation according to another embodiment of the present invention will be described with reference to FIG. 9.

When a missile is launched by combustion of a missile propellant (not shown), a rail assembly portion 20*a* of a shoe 20 carries out sliding movement on a rail 2 of a launch tube 1 in the launching direction. The instant when the rail assembly portion 20*a* of the shoe 20 deviates from the rail 2 of the launch tube 1, the shoe 20 enters into a free state with no restriction.

At this point, as the pressure cartridge 29 in the bushing 23 is operated by an electrical signal and a high explosive gas pressure 30 of gunpowder is produced in the pressure concentrating portion 28 formed in the boss portion 20*b* of the shoe 20, the shoe 20 is pushed outward from the missile radius direction from inside the bushing 23 within a short time.

As previous described in another embodiment of the present invention, as for the application of a pressure cartridge to a missile launch and guidance apparatus in order to generate a shoe separating force, it is preferred that a pressure cartridge is installed, when applied to a missile, in a position requiring a high separation speed because it is small-sized and requires a large actuating force. Particularly, it is more useful for a pressure cartridge to be applied to a missile where an external structure having a risk of collision with the rear of the shoe position upon separating the shoe is assembled. Further, it is preferred to have a safety device (not shown) for preventing a warhead or missile body loaded on the missile from being destroyed due to the explosion of gunpowder from the pressure cartridge.

A cylindrical shoe boss portion, designed to minimize the effects caused by a rail state, a posture of missiles, such as guided missiles or rockets, and so on, and make separation easier, and a missile launch and guidance apparatus using a spring elastic force and an explosive pressure of gunpowder from a pressure cartridge as the shoe separating force are also applicable to similar weapon systems.

The present invention has been described with reference to the preferred embodiments. However, the present invention is not limited to these particular embodiments, and various changes and modifications may be made within the scope of the appended claims.

As described above, the present invention provides a missile launch and guidance apparatus, in which a shoe is separated from a missile body after launching the missile, so that the maximum flight performance can be exhibited, including: the missile is firmly and steadily supported on a rail of a missile tube in a pre-launching operation; the missile is able to carry out a constant sliding movement during a launching process irrespective of an unstable behavior, such as tip-off caused by the rotational motion of the shoe, and the surface state of the launch tube rail; and the flight performance is improved due to a reduction of the drag and a much farther range is obtained due to a reduction of the missile weight during flight after launching.

Furthermore, the present invention provides a missile launch and guidance apparatus, which can keep a constant gap between a shoe and a rail regardless of the behavior of a missile taking place in a launching process by using a spring as means for separating the shoe.

In addition, the shoe of the present invention using the pressure cartridge as means for separating the shoe is installed, when applied to a missile, in a position requiring a high separation speed because it is small-sized and requires a large actuating force, thereby reducing the risk of collision with the rear of the shoe position upon separating the shoe.

Furthermore, the present invention provides a separable missile launch and guidance apparatus, which offers excellent reliability, operability, assembling property, and economic efficiency because it has a simple structure and excellent actuating force and can adjust the separating force.

What is claimed is:

1. A missile launch and guidance apparatus, comprising:

a bushing inserted into a missile body that moves along a rail of a launch tube, the bushing having a bushing flange portion disposed on a circumference of an opening formed at one end thereof;

a shoe having two ends, one end of which is inserted into the bushing, and the other end of which is in contact with the rail;

a spring inserted between the bushing and the shoe so as to provide a separation force to the shoe against the bushing, and a bushing receiving groove formed in the missile body for receiving the bushing, the groove having two ends with a flange mounting portion formed at one end thereof and configured so as to be coupled to the bushing flange portion, and the flange portion of the groove inwardly protruding from the missile body toward the other end thereof.

2. The apparatus of claim 1, wherein an air vent hole is formed in the bushing.

* * * * *